United States Patent [19]

Umeda et al.

[11] Patent Number: 4,576,588

[45] Date of Patent: Mar. 18, 1986

[54] ADJUSTABLE TUBE FORMING APPARATUS

[75] Inventors: Yoshiaki Umeda; Ryouhei Matsumoto; Hiroyasu Isomura; Hisakuni Shimotaka, all of Nagoya, Japan

[73] Assignee: Fuji Machinery Company, Ltd., Nagoya, Japan

[21] Appl. No.: 657,250

[22] Filed: Oct. 3, 1984

[30] Foreign Application Priority Data

Nov. 30, 1983 [JP] Japan ..... 58-227679
Apr. 16, 1984 [JP] Japan ..... 59-77012

[51] Int. Cl.[4] ..... B31B 1/40; B31B 27/26; B65B 9/06

[52] U.S. Cl. ..... 493/475; 493/302; 493/466; 53/551

[58] Field of Search ..... 493/269, 271, 293, 302, 493/395, 461, 466, 474, 303, 475; 53/551; 72/52, 368

[56] References Cited

U.S. PATENT DOCUMENTS 3,296,770 1/1967 Wilson ..... 53/552
3,415,171 10/1968 Wilson ..... 493/302

FOREIGN PATENT DOCUMENTS 53-50697 4/1978 Japan ..... 221/92
55-66906 5/1980 Japan ..... 493/302
2037638 7/1980 United Kingdom ..... 72/52
417343 7/1974 U.S.S.R. ..... 493/302

*Primary Examiner*—Lowell A. Larson
*Assistant Examiner*—William E. Terrell
*Attorney, Agent, or Firm*—Schwartz & Weinrieb

[57] ABSTRACT

An apparatus for forming a web of wrapping material into a tubular configuration is disclosed. The apparatus is basically composed of a highly flexible, elongated elastic sheet material secured at one end, the sheet material extending obliquely upwardly and then returning to form a loop, and an actuator mechanically connected to the other end of the sheet material, the actuator being operable to advance and retract the sheet material so as to contract and expand the loop formed by the sheet material.

4 Claims, 12 Drawing Figures

110
132
G
118
130
120
110
110
A
B
114
168
186
118
134
130
164
158
166
184
VII
VII
139
144
124
140
136
122
142

ADJUSTABLE TUBE FORMING APPARATUS

BACKGROUND OF THE INVENTION

1. Field of the Invention

This invention relates to an apparatus for forming a wrapping web into a tubular configuration. More particularly, it relates to a former for use in a form-fill-packaging machine of the type in which a web of wrapping material is formed into a wrapping tube to entube articles, the resulting tube of wrapping material being filled with articles and subsequently sealed intermediate the entubed articles. This invention is concerned with an improvement on such a former by means of which the diameter of the opening of formed wrapping tubes may be steplessly adjusted; and with an improved actuating mechanism adapted to adjustably advance and retract an elastic sheet material constituting the former.

2. Description of the Prior Art

Web forming devices or formers are usually used in vertical packaging machines, horizontal packaging machines and all the other form-fill-sealing machines of the type in which a wrapping web is formed into a tubular body which is to be filled with articles and sealed on three or four of its sides so as to entube the articles. Thus, the formers are utilized to form a wrapping web fed from the parent roll into a tubular body, and various types of formers have hitherto been proposed to form such a wrapping tube. In general, previously known formers are of the fixed type in which the diameter of the formed tubular body cannot be varied. When it is desired to change the diameter of packages, therfore, a suitably sized former is selected from variously sized formers prepared beforehand, to conform to the desired size of the wrapping tube to be formed. It is to be noted, however, that an extremely intricate operation is required to replace the former, and the machine operation has to be interrupted for replacing the former, thereby decreasing the operating efficiency.

Thus, in view of the requirement that dimensions of tubular packages be altered depending upon the various factors such as the shape, size and volume of the objects to be wrapped, several web forming devices have hitherto been proposed which permit production of tubular packages having changing diameters by variably adjusting the width of the tubular web. For instance, Japanese Utility Model Publication No. 53-50697 discloses a technical conception wherein the machine body includes an extension having an opening and adapted to carry a pair of web forming devices each having an L-shaped fixture. The backside gap between the web forming devices is adjusted by loosening and moving tightening screws of the L-shaped fixtures, to thereby obtain a desired width of the wrapping tube to be formed. In this prior art device, however, the range of adjustment in the opening width is narrow and yet the arrangement is complicated and the operation is troublesome. Thus, it is practically difficult to produce tubular packages of arbitrary sizes by such a device.

Japanese Laid-Open Utility Model Publication No. 55-66906 discloses a former which comprises a combination of two semi-tubular divided bodies, the spacing between the bodies being adjustable by means of bolts and nuts. In this arrangement, however, the chute serving as a forming tube is inserted within the former and yet the size of the outer periphery of the chute is fixed. Apparently, the range of adjustment of the wrapping tube diameter is extremely limited as with the device illustrated in Publication No. 53-50697.

Another disadvantage found in the prior art devices is that the gap adjusting mechanism used therfor is relatively complex in construction and yet gaps cannot be arbitrarily determined for various sizes of wrapping tubes.

OBJECTS OF THE INVENTION

It is, accordingly, an object of the present invention to eliminate the above disadvantages associated with the previously known formers used in form-fill-packaging machines.

It is another object of the present invention to provide a novel web forming apparatus by means of which the opening diameter of formed wrapping tubes may be freely adjusted depending on the various requirements such as the shape of articles, the filling amount and the users' specific needs, so as to form tubular packages with stable shapes and various opening sizes.

It is a further object of the present invention to provide, in conjunction with the opening diameters of wrapping tubes, a novel adjusting mechanism which is compact in construction and which is readily accessible for operation.

SUMMARY OF THE INVENTION

In accordance with the present invention, there is provided an apparatus for forming a web of wrapping material which comprises a rectangular frame with an open center; a first and a second transversely spaced apart support members mounted within the frame; a highly flexible, elongated elastic sheet material fixedly connected at one end to the first support member, the sheet material extending obliquely upwardly from the fixed one end toward the second support member and returning to form a loop, the returning other end of the sheet material intersecting in front of the fixed one end and extending obliquely downwardly; and actuating means fixedly mounted to on and disposed generally below the first support member for connection to the downwardly extending other end of the sheet material, the actuating means being adapted to advance and retract the sheet material, whereby the advancing and retracting movement of the actuating means causes the loop formed by the sheet material to be freely contracted and expanded.

In accordance with a more limited aspect of the present invention, the actuating means comprises a support plate fixedly connected to the first support member; a pair of longitudinally spaced apart support blocks secured to the support plate; a threaded shaft rotatably carried by the support blocks, the threaded shaft having one end extending through and projecting from one of the support blocks; a handwheel secured to the one end of the threaded shaft and adapted to rotate the threaded shaft; and a sliding block threadedly carried on the threaded shaft between the support blocks and adapted to fixedly connect the other end of the sheet material thereto; whereby rotation of the handwheel in either direction causes the sliding block to advance and retract along the threaded shaft, thereby advancing and retracting the other end of the sheet material secured to the sliding block.

In an alternative form of the present invention, the actuating means comprises a pair of rollers adapted to pressingly hold the other end of the sheet material therebetween; and means for driving the rollers for rotation so as to advance and retract the sheet material held between the rollers.

BRIEF DESCRIPTION OF THE DRAWINGS

The invention will now be described by way of example and with reference to the accompany drawings, in which.

DETAILED DESCRIPTION OF THE INVENTION

Figure 1:
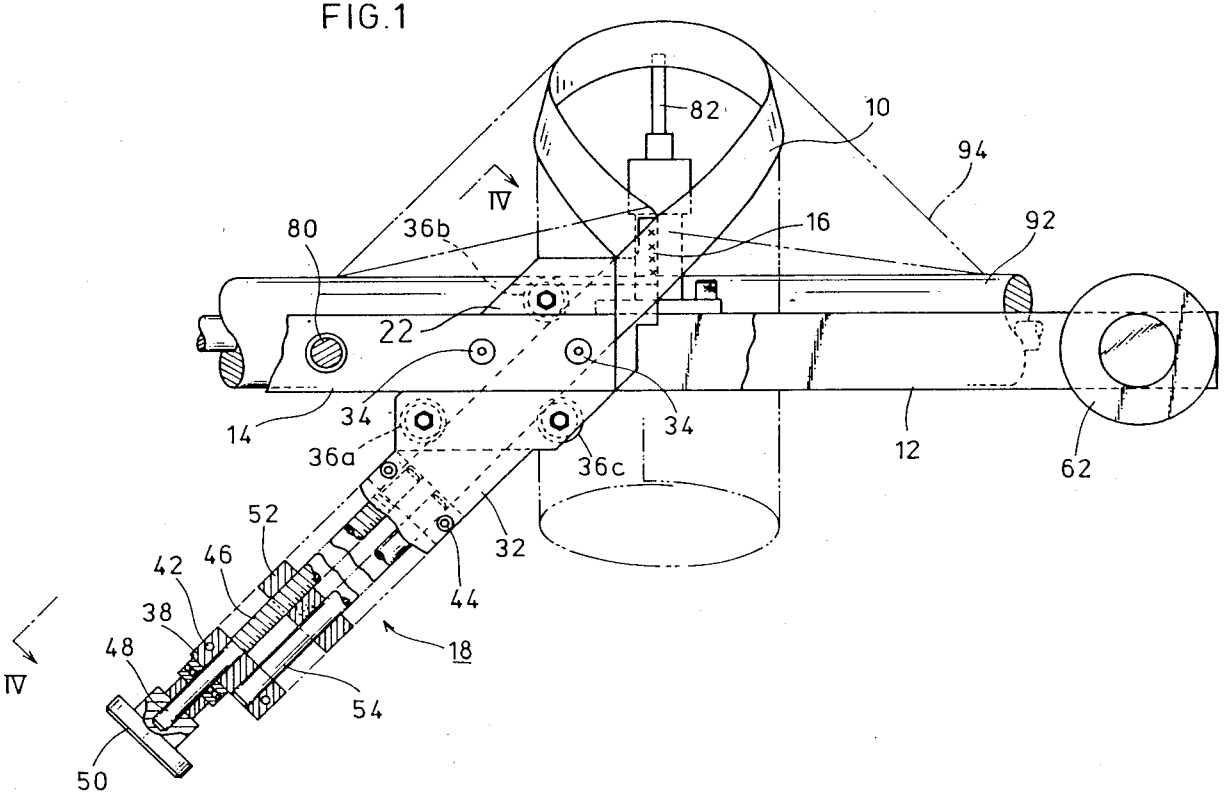
FIG. 1 is a partially cut-away front view illustrating the general construction of a web forming apparatus of the invention.

Referring to the drawings and to FIG. 1 in particular, shown therein and generally designated by the reference numeral 10, is a highly flexible, elongated elastic sheet material such as a stainless steel sheet. The apparatus of the invention is supported on a rectangular frame 12 (see FIG. 2) which includes a support member 14 and an actuating mechanism 18 for the elastic sheet material 10. The support member 14 is movably mounted relative to the frame 12 and is connected to one end of the sheet material 10 through a bolt 16. The other end of the sheet material 10 is connected to the actuating mechanism 18 for reciprocating movement therewith. Specifically, one end of the elastic sheet material 10 is fixedly connected through the bolt 16 to a securing member 22 secured to the support member 14 through support shafts 20 for later described guide rolls (see FIG. 2). The sheet material 10 extends obliquely upwardly from the securing member 22, as shown in FIG. 1, the other end returning toward the secured position, while forming a loop in a clockwise direction and with a predetermined angle $\alpha$ of inclination relative to the vertical line H(see FIG. 3). The returning end of the sheet material 10 intersects generally in front of the secured one end in non-contacting manner and then extends obliquely downwardly to be connected to a sliding block 52 provided in the actuating mechanism 18 which will hereinafter be described in greater detail. It will be noted that the support member 14 is adapted to move toward and away from another support member 28 located within the rectangular frame 12 in response to the actuation of a relative movement mechanism which will be explained later.

Figure 4:
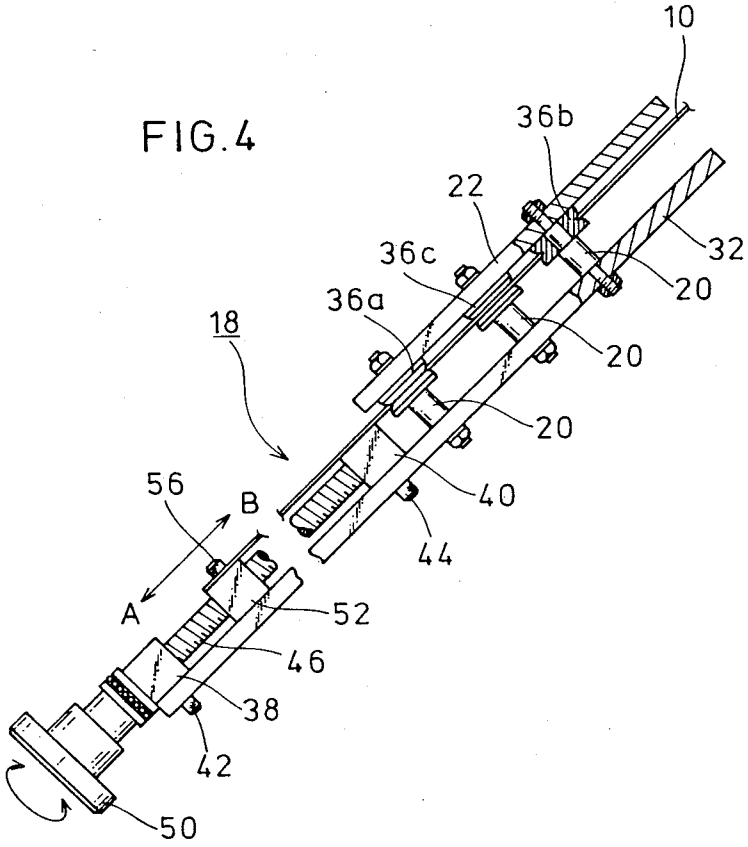
FIG. 4 is a plan view, of the sheet material actuating mechanism used in the invention apparatus, taken in the direction of the line IV—IV of FIG. 1.

FIGS. 1 and 4 illustrate in more detail the structure of the actuating mechanism 18 which is mounted on the support member 14. As previously discussed, the returning other end of the elastic sheet material 10 intersects in front of the securing member 22 and extends obliquely downwardly. Thus, in order to smoothly guide the obliquely downward movement of the sheet material 10, three guide rollers are provided in the instant embodiment. Specifically, the support member 14 has an integral extension 30(see FIG. 2) to which a support plate 32 is mounted by means of bolts 34. A plurality of support shafts 20 (three in the instant embodiment) are bolted to the support plate 32. The support shafts 20 have guide rollers 36*a*, 36*b* and 36*c* rotatably mounted thereon, respectively, the periphery of each guide roller being provided with a V-shaped recess, as shown in FIGS. 1 and 4. The guide rollers 36*a* and 36*b* are arranged to guidingly hold the upper longitudinal edge of sheet material 10, while roller 36*c* is arranged to guidingly hold the lower longitudinal edge of the sheet material 10. Thus, it will be appreciated that the plurality of guide rollers cooperate to slidably hold the sheet material 10 therebetween. Further, as best seen in FIG. 4, the securing member 22 is mounted on the other ends of the support shafts 20, respectively.

The support plate 32 extends obliquely downwardly relative to the support member 14 and includes the actuating mechanism 18 generally at the downward end thereof. As represented in FIGS. 1 and 4, the actuating mechanism 18 is basically composed of a pair of support blocks 38 and 40, a threaded shaft 46, a sliding block 52 threadedly supported on the threaded shaft 46 and a handwheel 50. Specifically, a pair of longitudinally spaced apart support blocks 38 and 40 are secured to one side surface of the support plate 32 by means of bolts 42 and 44. The support block 38 rotatably receives the shank portion 48 of the threaded shaft 46 therein, and the other support block 40 receives the free end of the threaded shaft 46. The shank portion 48 extends outwardly from the support block 38 and a handwheel 50 is secured to the projecting end portion of the threaded shaft 46.

The sliding block 52 is threadedly carried on the threaded portion of the threaded shaft 46 between the support blocks 38 and 40. Thus, upon rotation of the handwheel 50 in either direction, the sliding block 52 may be advanced and retracted along the threaded shaft 46 in the direction of arrows A and B. Further, in order to support the sliding block 52 against rotational movement as well as to guide the sliding block 52 for its smooth sliding movement, a round guide bar 54 is fixedly mounted within the support blocks 38 and 40 and slidably received in the sliding block 52. As best seen in FIG. 4, the other end of the sheet material 10 is secured to the sliding block 52 by means of a bolt 56. Thus, rotation of the handwheel 50 provided in the actuating mechanism 18 causes the sheet material 10, being secured to the sliding block 52, to advance and retract in the direction of arrows A and B. Thus, it can be appreciated that as the elastic sheet material 10 advances in the direction of arrow A, the loop is contracted in a direction reducing the diameter; and conversely, as the elastic sheet material 10 retracts in the direction of arrow B, the loop is expanded in a direction increasing the diameter.

Figure 2:
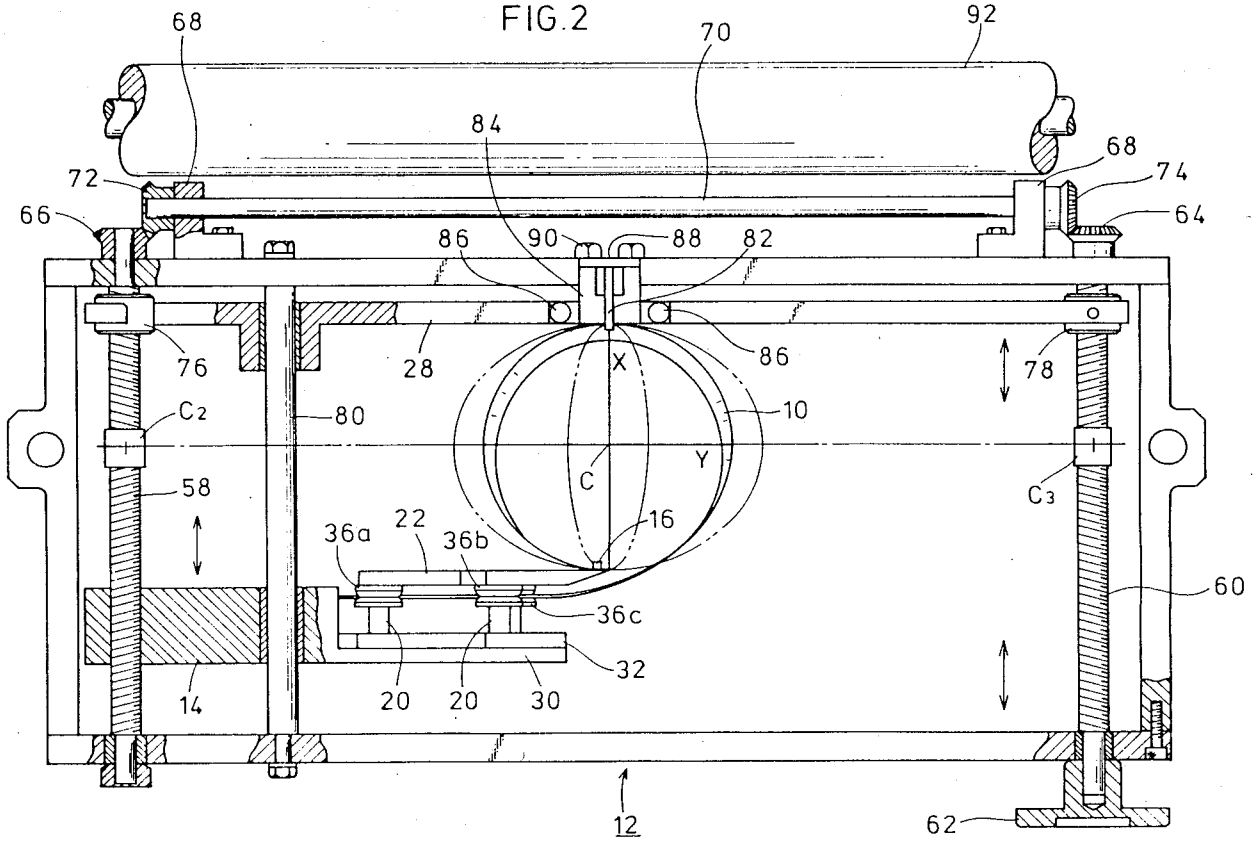
FIG. 2 is a plan view illustrating the overall construction of the invention apparatus.

Referring to FIG. 2, the present invention involves a mechanism for moving the first and the second support members 14 and 28 relative to each other. The mechanism is so provided that a substantially uniform circular loop may be formed without shifting the center C when it is desired to contract or to expand the elastic sheet material 10. To this end, the rectangular frame 12 includes a pair of threaded shafts 58 and 60 which are inversely threaded relative to each other and which are rotatably supported on the rectangular frame 12 adjacent the longitudinally opposite ends thereof. The threaded shaft 60 extends through the frame 12 and has a handwheel 62 connected to one end thereof and a bevel gear 64 secured to the other end thereof. Similarly, the threaded shaft 58 has a bevel gear 66 secured to the rear end projecting outwardly from the frame 12. As shown in FIG. 2, The rectangular frame 12 also includes a rotary shaft 70 rotatably mounted thereon through a pair of bearings 68. The rotary shaft 70 has bevel gears 72 and 74 at its opposite ends for meshing engagement with the bevel gears 66 and 64, respectively. The threaded shafts 58 and 60 include guide nuts 76 and 78, respectively, to which the support member 28 is fixedly secured. Additionally, the shaft 58 is threadedly connected to the support member 14, and the frame 12 has a transversely extending guide bar 80 fixedly connected thereto for slidably receiving the support members 14 and 28. It will be noted that the threads of the shaft 58 with which the support member 14 is threadedly engaged are cut in the opposite direction relative to those threads with which the support member 28 is threadedly engaged. Thus, rotation of the handwheel 62 in a desired selected direction causes the threaded shafts 58 and 60 mechanically connected through the bevel gears to rotate in opposite directions, thereby moving the support members 14 and 28 toward and away from each other.

Figure 3:
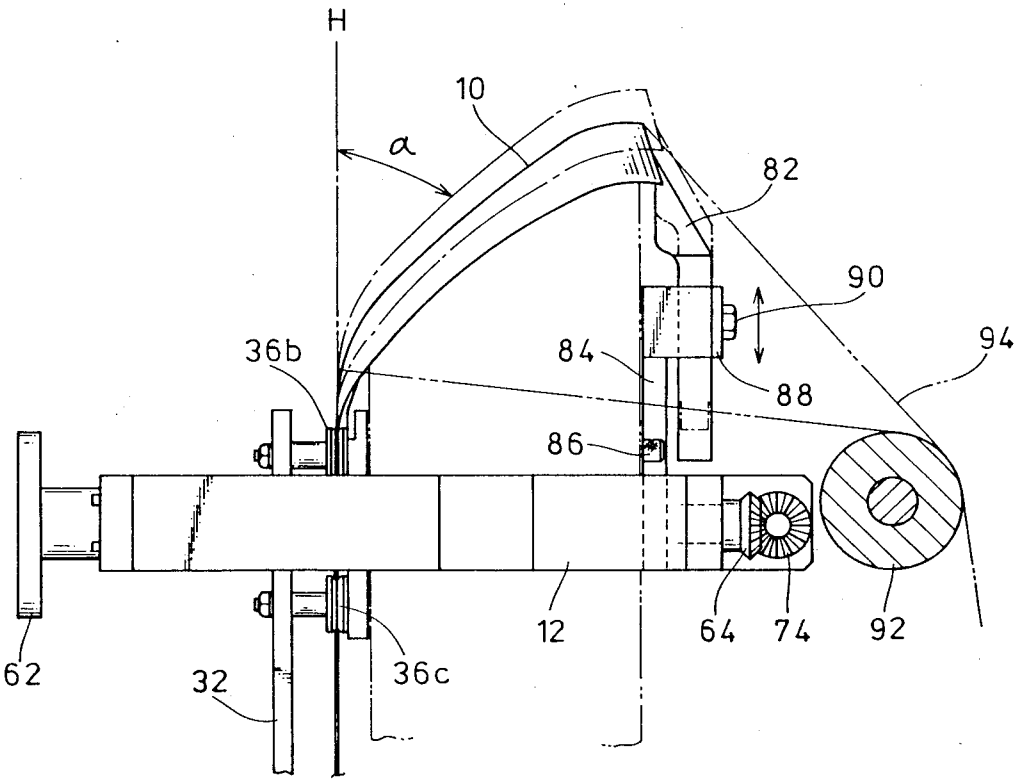
FIG. 3 is a side view of the invention apparatus.

As shown in FIGS. 2 and 3, the support member 28 includes a holding member 82 which is adjustable in its height and which has a slit-like groove formed therein for slidably receiving the rearward lower edge of the sheet material 10. Specifically, as shown in FIGS. 2 and 3, the support member 28 includes an upright base 84 secured thereto through a bolt 86 and extending vertically therefrom. The upright base 84 has at the back thereof a vertical groove in which the holding member 82 is slidably received in a vertical direction. The holding member 82 may be clamped against the upright base 84 at a desired selected height through a bolt 90 and a mounting plate 88. It will be appreciated that the holding member 82 may be raised and lowered to obtain an arbitrary height thereof by loosening the bolt 90. As previously mentioned, the holding member 82 has formed therein a slit-like groove in which the lower edge of the sheet material 10 is slidably received and stably held at a predetermined height.

In FIGS. 2 and 3, reference numeral 92 designates a roller which guides a web of wrapping material 94 fed from the source of web supply (not shown) into the web forming device formed by the sheet material 10.

Now the operation and effect of the invention web forming apparatus will be described. It is assumed in FIG. 2 that the diameter of the web forming device formed by a loop of elastic sheet material is 130 mm. If it is required that the opening diameter of wrapping tubes be 90 mm to meet various requirements such as the shape of articles to be wrapped and the amount of articles to be filled, the operation will follow the following procedures. First, the handwheel 50 arranged in the actuating mechanism 18 is rotated to thereby rotate the threaded shaft 46. As the shaft 46 rotates, the sliding block 52 is advanced in the direction of arrow A along the guide bar 54. As this occurs, the elastic sheet material 10 connected with the sliding block 52 is pulled in the direction of arrow A. Since the one end of the sheet material 10 is secured to the securing member 22 and the lower edge of the loop formed by the sheet material 10 is slidably held by the holding member 82, the advancement of sliding block 52 in the direction of arrow A causes the sheet material 10 to be gradually contracted to thereby reduce its diameter. The handwheel 50 is rotated until the diameter of the loop in a plane reaches 90 mm. The web forming device formed by the sheet material 10 has now been so dimensioned as to permit formation of a wrapping tube having a desired opening diameter.

As is apparent, however, the distance is constant between the securing member 22 securely holding the one end of the sheet material 10 and the support member 28 with the holding member 82 guidingly holding the lower edge of the loop. Therefore, by only rotating the handwheel 50, the contracted loop will represent an ellipse in which the x-axis is the major axis and will not maintain a circle close to a true one. Then, the handwheel 62 is rotated, rotating the inversely threaded shafts 58 and 60 and moving the support members 14 and 28 relatively toward each other, so that the major axis on the x-axis substantially coincides with the minor axis on the y-axis. It is important to note in FIG. 2 that point C is positioned on a straight line connecting the parting points C2 and C3 from which the respective shafts 58 and 60 are inversely threaded. Thus, relative movement of the support members 14 and 28 toward and away from each other will not shift the center C of the loop.

Conversely, if it is desired to obtain wrapping tubes having an opening diameter larger than 130 mm, for example, 150 mm, an inverse operation will be performed. Specifically, rotation of the handwheel 50 on the actuating mechanism 18 in the direction retracting the sliding block 52, that is in the direction of arrow B, causes the other end of the sheet material 10 to be pushed back, thereby progressively spreading the loop and hence expanding its diameter. The handwheel 50 is rotated until the desired diameter 150 mm is reached. At this time, the loop is formed into an ellipse in which the y-axis is the major axis as is shown in FIG. 2. Then, the handwheel 62 of the relative movement mechanism is rotated, thereby moving the support members 14 and 28 relatively away from each other, to obtain a loop close to a true circle in which the minor axis on the x-axis substantially coincides with the major axis on the y-axis. Again, the center of the loop formed by the sheet material 10 will preferably not shift for the same reason as previously described.

Thus, the web 94 is fed from the roller 92 to the web forming device formed by the elastic sheet material 10 and is drawn into the device to form a wrapping tube having a desired diameter. It will be noted that the height of the holding member 82 is preferably adjusted to an optimum value depending on the degree of loop diameter and the angle of entry of the web 94 fed from the roller 92.

From the foregoing detailed description, it can be seen that the present invention provides a novel web forming apparatus in which the opening diameter of wrapping tubes formed thereby may be arbitrarily set within a predetermined range. Also, it can be appreciated that the diameter of the web forming device is readily changed and yet the device eliminates the need for complicated replacement operations as was required with the prior art web forming device, thereby reducing the time required to interrupt the operation of a form-fill-sealing machine and substantially improving the operating efficiency thereof.

Although the preferred embodiment utilizes a stainless steel sheet for the elastic sheet material, it is obvious that other members having equally good flexibility and elasticity can be utilized. For example, these members could be a plastic sheet material which satisfies the above requirements. Also, although the embodiment has been described in relation to the use of a handwheel for operating the actuating mechanism, it will be appreciated that other types of actuators could be employed. For example, these actuators could be a hydraulic actuator, a pneumatic actuator or an electric motor which may be driven in either the forward or reverse direction.

Figure 5:
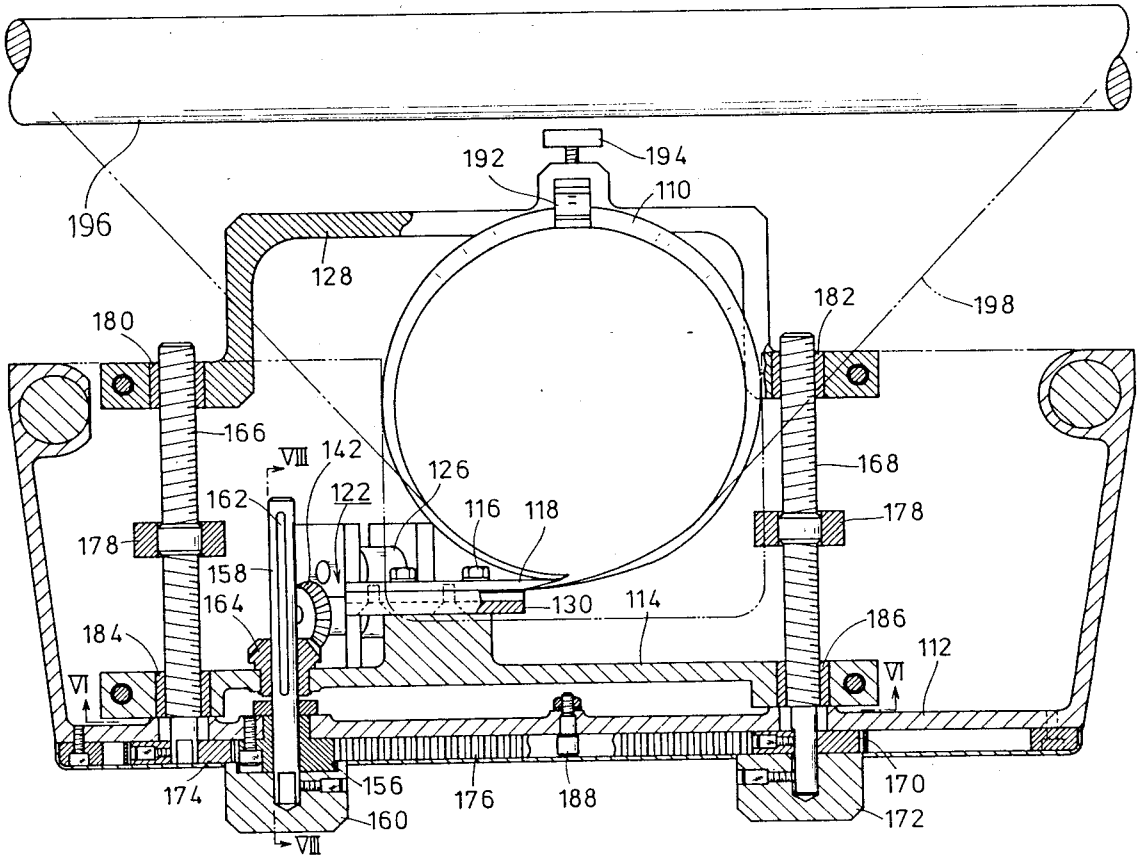
FIG. 5 is a plan view partly in cross-section illustrating the web forming apparatus in which an alternative arrangement of sheet material actuating mechanism may be utilized.

FIGS. 5 through 11 illustrate another web forming apparatus in which an alternative arrangement of a sheet-material actuating mechanism may be utilized. Referring to FIG. 5, shown therein and generally designated by the reference numeral 110 is a highly flexible, elongated elastic sheet material such as a stainless steel sheet. The web forming apparatus is supported on a frame 112 which includes a support member 114 and an actuating mechanism 122 for the sheet material 110. The support member 114 is movably mounted relative to the frame 112 and has a mounting member 118 secured thereto by bolts 116. The elastic sheet material 110 is secured at one end of the mounting member 118 through suitable securing means 120. The other end of the sheet material 110 is connected to the actuating mechanism 122 for advancing and retracting movements.

Figure 9:
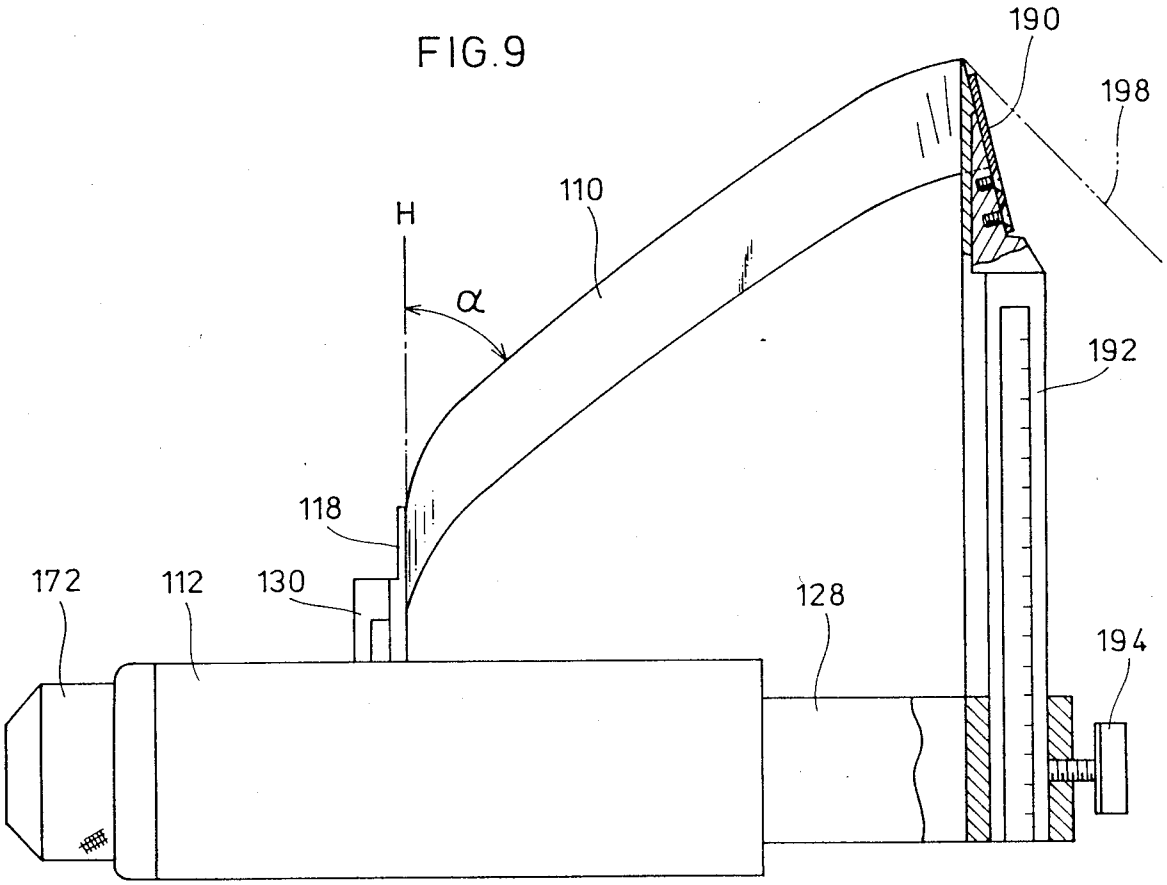
FIG. 9 is a schematic side view of the web forming apparatus of FIG. 5.
Figure 10:
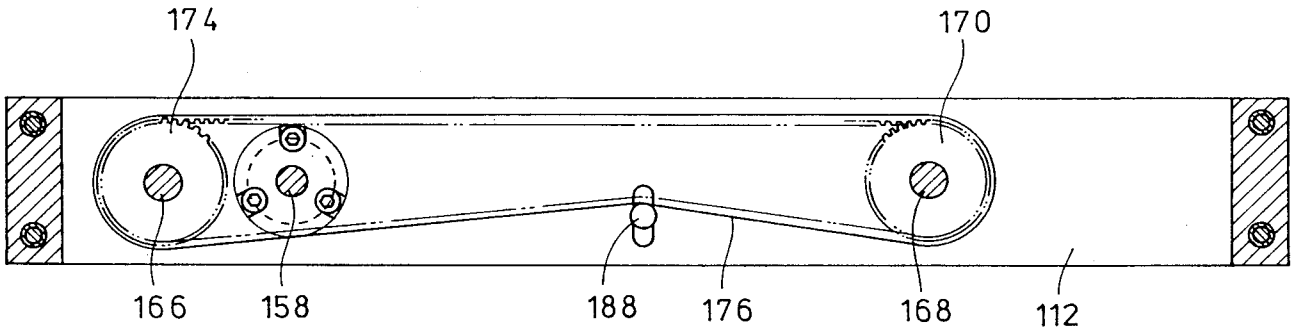
FIG. 10 is a front view of the frame of the web forming apparatus.
Figure 11:
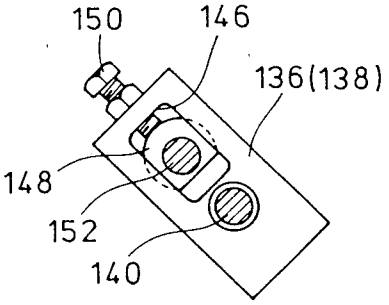
FIG. 11 is a plan view of a roller support plate in the actuating mechanism.

The sheet material 110 extends obliquely upwardly from the mounting member 118, the other end returning to the secured position, while forming a loop in a clockwise direction and with a predetermined angle $\alpha$ of inclination relative to a vertical line H, as shown in FIG. 9. The returning end intersects generally in front of the secured one end in a non-contacting manner and then extends obliquely downwardly to be held between a pair of rollers 124 and 126 arranged in the actuating mechanism 122. It will be noted that the support member 114 is adapted to move toward and away from another support member 128 within the frame 112 in response to the actuation of a relative movement mechanism which will be explained later.

Figures 6A, 6B:
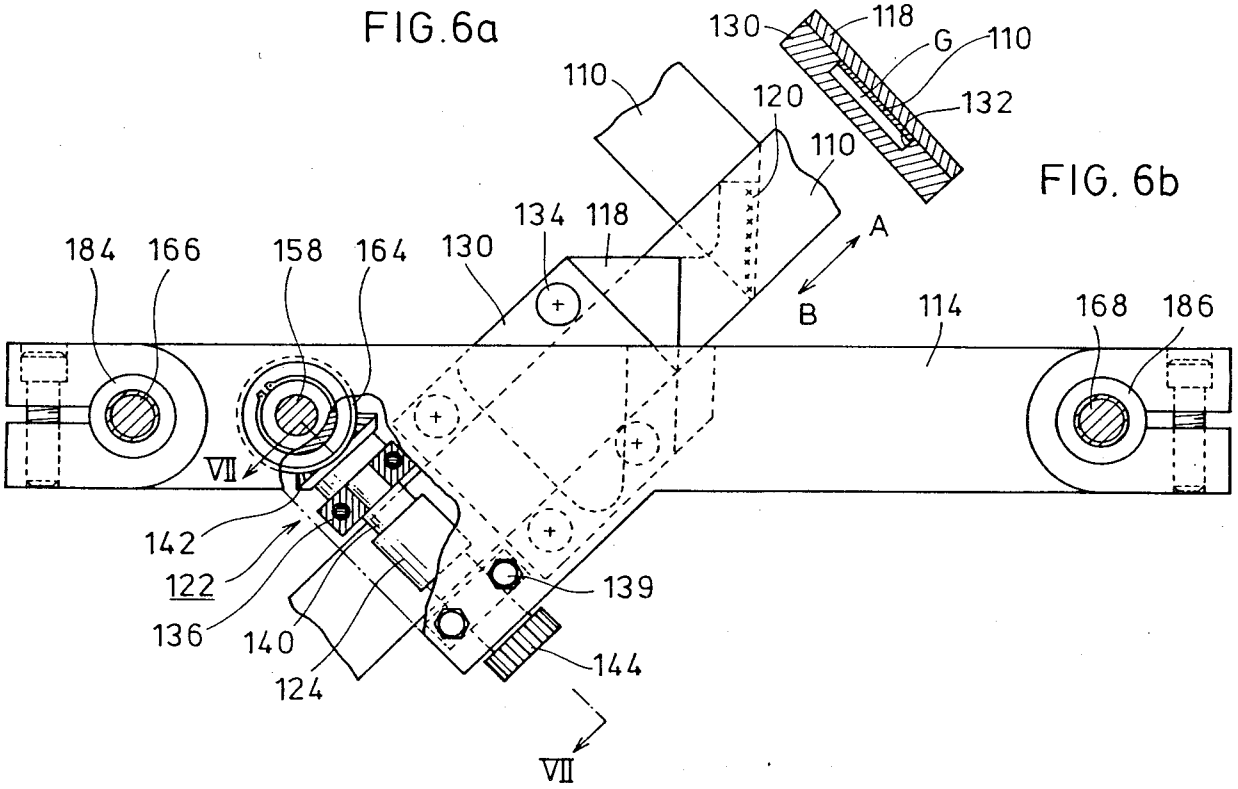
FIG. 6*a* is a vertical cross-sectional view illustrating the general construction of the actuating mechanism shown in FIG. 5 taken substantially along the line VI—VI of FIG. 5.
FIG. 6*b* is a cross-sectional view of the apparatus shown in FIG. 6*a* taken along the lines 6*b*—6*b* of FIG. 6*a;*

The actuating mechanism 122 will now be described in greater detail. As described in the preceding paragraphs, the returning other end of the elastic sheet material 110 intersects in front of the mounting member 118 and extends obliquely downwardly to pass through a guide passage formed between the mounting member 118 and a guide member generally designated by numeral 130. Specifically, the guide member 130 has a guide channel 132 on its one flat surface, as shown in FIG. 6*b*. The guide member 130 overlaps the mounting member 118 with the guide channel 132 facing the mounting member 118, and both members 118 and 130 are clamped by bolts 134, thereby to form a guide passage G therebetween. The guide passage G serves to slidably guide the elastic sheet material 110. It is important to note, therefore, that the guide passage G is oriented at an angle commensurate with the path of the elastic sheet material 110 extending obliquely downwardly.

After passing through the guide passage G, the elastic sheet material 110 is frictionally held between a pair of rollers 124 and 126 rotatably mounted on the support member 114, and is advanced and retracted by rotation of the rollers 124 and 126 to thereby freely contract and expand the diameter of the loop formed by the elastic sheet material 110. As may be seen in FIG. 7, which is a cross-sectional view taken along the line VII—VII of FIG. 6, the support member 114 has on its back surface a pair of roller support plates 136 and 138 secured thereto by bolts 139 and spaced a slightly greater distance than the crosswise width of the elastic sheet material 110. Mounted rotatably to the lower portion (as viewed in FIG. 7) of the roller support plates 136 and 138 adjacent the support member 114 is a drive shaft 140 which in turn has a drive roller 124 fixedly supported thereon. The roller 124 is preferably of hard rubber having a large coefficient of friction. The drive shaft 140 has one end extending outwardly from the roller support plate 136 and including a bevel gear 142 secured thereto; and has the other end extending outwardly from the roller support plate 138 and including a spur gear 144 secured thereto. Each of the roller support plates 136 and 138 has at its upper portion (away from the support member 114) a rectangular opening (see FIG. 11) in which a bearing 148 is slidably received (see FIG. 7). The bearing 148 rotatably carries a driven shaft 152 which in turn carries another roller 126 secured thereto and disposed between the roller support plates 136 and 138. The roller 126 is rolled by the roller 124 with the sheet material 110 held between these rollers. The driven shaft 152 has one end extending outwardly from the roller support plate 138 and including secured thereto a spur gear 154 which meshes with the aforesaid spur gear 144. Additionally, each of the roller support plates 136 and 138 has an adjusting bolt 150 vertically threadedly received in the top thereof, the free end so contacting the bearing 148 that with rotation of the bolt 150, the pressure may be freely adjusted between the rollers 124 and 126.

Figure 8:
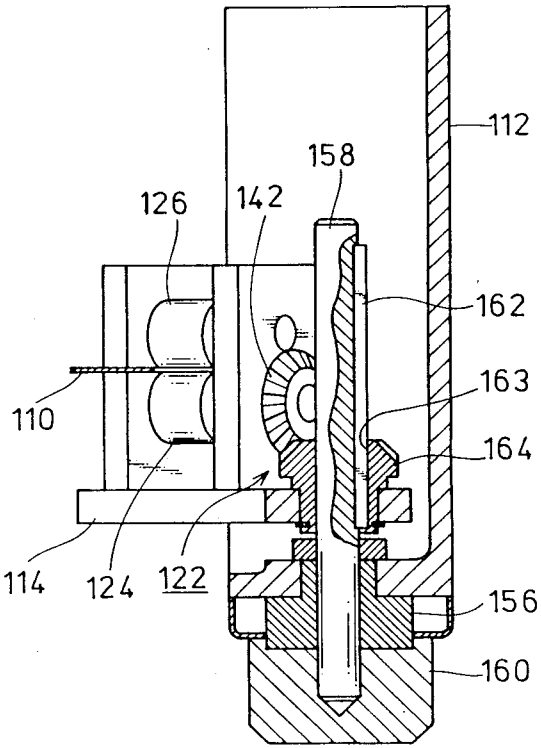
FIG. 8 is a cross-sectional view taken substantially along the line VIII—VIII of FIG. 5.
Figure 7:
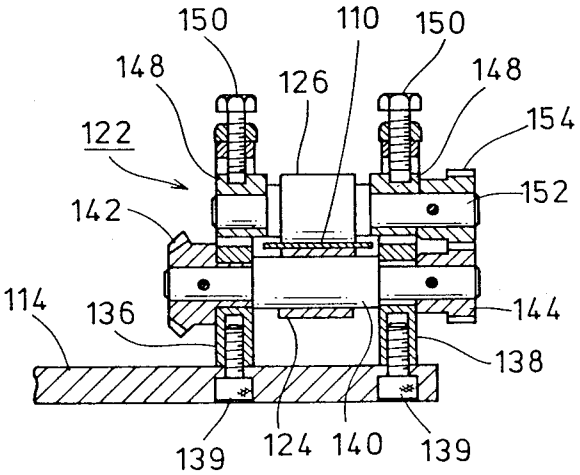
FIG. 7 is a cross-sectional view taken substantially along the line VII—VII of FIG. 6.

As shown in FIGS. 5 and 8, the frame 112 has a sleeve 156 horizontally mounted on the vertical front surface thereof. The sleeve 156 has a shaft 158 rotatably supported therein. The shaft 158 has one end extending outwardly from the frame 112 and including a knob 160 secured thereto. The shaft 158 is formed with a thrust key 162 extending over the length of the shank thereof. The thrust key 162 is received in a bevel gear 164 as shown in FIG. 8 which is formed with a thrust groove 163 in the central bore thereof. As best seen in FIG. 5, the bevel gear 164 is rotatably carried by the support member 114 and is meshed with the bevel gear 142 mounted on the drive shaft 140 extending at right angles relative to the shaft 158. Since the thrust key 162 of the shaft 158 is engaged with the thrust groove 163 of the bevel gear 164, the bevel gear 164 is allowed to slide in the axial direction when the support member 114 carrying the bevel gear 164 is moved relative to the support member 128 as will hereinafter be described in greater detail.

Thus, rotation of the knob 160 in a predetermined direction causes the drive shaft 140 to rotate through the shaft 158 and the bevel gears 164 and 142, thereby driving the roller 124 for rotation. The roller 126 is also rotated through spur gears 144 and 154, thereby advancing and retracting the elastic sheet material 110 held between the rollers 124 and 126 along the guide channel G. It can be appreciated that as the elastic sheet material 110 is advanced in the direction of arrow A shown in FIG. 6, the loop is expanded in a direction increasing its diameter; and conversely, as the elastic sheet material 110 is retracted in the direction of arrow B, the loop is contracted in a direction reducing its diameter.

Referring to FIG. 5, a brief description will be given in relation to a mechanism for moving the support members 114 and 128 relative to each other. The mechanism is so provided that a substantially uniform circular loop may be formed without shifting the center C when it is desired to contract or to expand the elastic sheet material 110. In the instant embodiment, there is provided a pair of shafts 166 and 168 which are inversely threaded relative to each other and which are rotatably supported at their non-threaded medial portions on support bases 178, respectively, which are located at suitable positions on the bottom of the frame 112. One end of each shaft 166 and 168 is threadedly supported by guide nuts 180 and 182 secured to the support member 128. The other ends of the shafts 166 and 168 are threadedly supported by guide nuts 184 and 186 secured to the support member 114. Additionally, the shaft 168 has one end projecting from the frame 112 and including a timing pulley 170 and a control knob 172 coaxially secured thereto. The shaft 166 has one end projecting outwardly from the frame 112 and also including a timing pulley 174 secured thereto. As may be seen in FIG. 10, the two timing pulleys 170 and 174 are connected by a timing belt 176. Reference numeral 188 designates a tension adjusting roller.

As discussed in the preceding paragraph, the shafts 166 and 168 are inversely threaded, and it will be important to note that the threads with which the support member 114 is threadedly engaged are cut in the opposite direction relative to those threads with which the support member 128 is threadedly engaged. Thus, rotation of the control knob 172 in a desired selected direction causes the threaded shafts 166 and 168, being mechanically connected through the timing pulleys 170 and 174 and the timing belt 176, to rotate in opposite directions, thereby moving the support members 114 and 128 toward and away from each other.

The support member 128 includes an upright member 192 which is adjustable in height and which has an engaging plate 190 secured thereto, as shown in FIG. 9. The upright member 192 and the engaging plate 190 are adapted to slidably receive and support the rearward lower edge of the sheet material 110. As shown in FIGS. 5 and 9, the support member 128 has at the back thereof a vertical groove in which the upright member 192 is slidably received in a vertical direction. The upright member 192 may be clamped by a bolt 194 at a desired selected height, and the upright member 192 may be raised and lowered to obtain an arbitrary height thereof by loosening the bolt 194.

In FIG. 5, reference numeral 196 designates a roller which guides a web of wrapping material 198 fed from the source of web supply (not shown) into the web forming device formed by the sheet material 110.

Now the operation and effect of the actuating mechanism of the instant embodiment will be described. It is assumed in FIG. 5 that the diameter of the web forming device formed by a loop of elastic sheet material 110 is 130 mm. If it is required that the opening diameter of wrapping tubes be 90 mm to meet various requirements such as the shape of articles to be wrapped and the amount of articles to be filled, the operation will follow the following procedures. First, the knob 160 mounted to the actuating mechanism 122 is rotated on thereby rotate the roller 124 mounted on the drive shaft 140 through the shaft 158 and the bevel gears 164 and 142. As this occurs, the roller 126 is also rotated through the spur gear 144 connected to the drive shaft 140 and through the spur gear 154 meshing with the spur gear 144. The elastic sheet material 110, being held between the rollers 124 and 126, is then retracted in the direction of arrow B along the guide passage G to be gradually contracted, reducing its diameter. The knob 160 is rotated until the diameter of the loop plane reaches 90 mm. The web forming device formed by the sheet material 110 has now been so dimensioned as to permit formation of a wrapping tube having a desired opening diameter.

It is to be noted, however, that the distance is constant between the mounting member 118 securely holding the one end of the sheet material 110 and the support member 128 with the upright member 192 guidingly holding the lower edge of the loop. By only rotating the knob 160, therefore, the contracted loop will represent an ellipse in which the x-axis is the major axis and will not maintain a circle close to a true one. The control knob 172 of the relative movement mechanism is then rotated, rotating the inversely threaded shafts 166 and 168 and moving the support members 114 and 128 relatively toward each other, so that the major axis on the x-axis substantially coincides with the minor axis on the y-axis.

Conversely, if it is desired to obtain wrapping tubes having an opening diameter larger than 130 mm, for example, 150 mm, an inverse operation will be performed. Specifically, rotation of the knob 160 on the actuating mechanism 122 in the direction advancing the sheet material 110, that is in the direction of arrow A, causes the loop to be expanded, increasing its diameter. The knob 160 is rotated until the desired diameter 150 mm is reached. At this time, the loop is formed into an ellipse in which the y-axis is the major axis. The control knob 172 of the relative movement mechanism is then rotated, moving the support members 114 and 128 relatively away from each other, to obtain a loop close to a true circle in which the minor axis on the x-axis substantially coincides with the major axis on the y-axis.

Thus, the web 198 is fed from the roller 196 to the web forming device formed by the elastic sheet material 110 and is drawn into the device to form a wrapping tube having a desired diameter. It will be noted that the height of the upright member 192 is preferably adjusted to an optimum value depending on the degree of the loop diameter and the angle of entry of the web 198 fed from the roller 196.

From the foregoing detailed description, it can be seen that the actuating mechanism illustrated in FIG. 6 is significantly compact in construction and is readily accessible for operation whereas the actuating mechanism illustrated in FIG. 1 is larger in construction and the control handwheel is located obliquely downwardly of the frame. In the actuating mechanism shown in FIG.

6, the control means located in front of the frame provides an increased mechanical advantage over the actuating mechanism shown in FIG. 1 and therefore, provides an actuating mechanism that is somewhat easier to operate.

Obviously, many modifications and variations of the present invention are possible in light of the above teachings. It is therefore to be understood that within the scope of the appended claims, the present invention may be practiced otherwise than as specifically described herein.

What is claimed is:

1. An apparatus for forming a web or wrapping material comprising:

a rectangular frame with an open center;

a first and a second transversely spaced apart support members mounted within said frame;

a highly flexible, elongated elastic sheet material fixedly connected at one end to said first support member, said sheet material extending obliquely upwardly from said fixed one end toward said second support member and then returning to form a loop, the returning other end of said sheet material intersecting in front of said fixed one end and extending obliquely downwardly; and means for freely contracting and expanding said loop formed by said sheet material, by advancing and retracting said sheet material, comprising actuating means fixedly mounted to and disposed generally below said first support member and connected to said downwardly extending other end of said sheet material.

2. An apparatus as defined in claim 1 wherein said actuating means comprises:

a support plate fixedly connected to said first support member;

a pair of longitudinally spaced apart support blocks secured to said support plate;

a threaded shaft rotatably carried by said support blocks, said threaded shaft having one end extending through and projecting from one of said support blocks;

a handwheel secured to said one end of said threaded shaft and adapted to rotate said threaded shaft; and a sliding block threadedly carried on said threaded shaft between said support blocks and adapted to fixedly connect said other end of said sheet material thereto;

whereby rotation of said handwheel in either direction causes said sliding block to advance and retract along said threaded shaft, thereby advancing and retracting said other end of said sheet material secured to said sliding block.

3. An apparatus as defined in claim 1 further comprising:

a pair of transversely extending spaced apart threaded shafts rotatably mounted to said frame, said shafts being inversely threaded relative to each other, while each of said shafts being inversely threaded intermediate the ends thereof to provide a first threaded portion and a second threaded portion;

said first support member with said one end of said sheet material connected thereto being threadedly engaged with and movable along said first threaded portion of one of said shafts;

said second support member being threadedly carried on said second threaded portions of said shafts for transverse movement relative to said first support member, said second support member having intermediate the ends thereof means for slidably holding the rearward lower edge of said sheet material;

a longitudinally extending rotary shaft mounted to said frame and operatively connected at the opposite ends thereof to the rear ends of said threaded shafts, respectively; and a handwheel secured to the front end of one of said threaded shafts, whereby rotation of said handwheel in either direction causes said first and said second support members to move toward and away from each other.

4. In an apparatus for forming a web of wrapping material including a frame, a support member mounted within the frame, and a highly flexible, elongated elastic sheet material fixedly connected at one end to the support member, the sheet material extending obliquely upwardly from the fixed one end and then returning to form a loop, the returning other end of the sheet material intersecting in front of the fixed one end and extending obliquely downwardly, actuating means for advancing and retracting said elastic sheet material comprising:

a pair of support plates secured at right angles to said support member;

a pair of rollers disposed between and rotatably carried by said support plates through rotary shafts, said rollers being operatively connected relative to each other for rotation in opposite directions and adapted to pressingly hold the downwardly extending other end of said sheet material;

a first bevel gear secured to one end of one of said rotary shafts;

a second bevel gear secured to said support member at right angles relative to said first bevel gear and meshed with said first bevel gear; and a shaft with a knob splined to said second bevel gear, whereby rotation of said shaft in either direction causes said sheet material held between said rollers to be advanced and retracted, thereby freely contacting and expanding the loop formed by said sheet material.

* * * * *